US008678948B2

(12) United States Patent
Wada et al.

(10) Patent No.: US 8,678,948 B2
(45) Date of Patent: Mar. 25, 2014

(54) GOLF CLUB HEAD

(75) Inventors: Kozue Wada, Chichibu (JP); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 352 days.

(21) Appl. No.: 13/043,845

(22) Filed: Mar. 9, 2011

(65) Prior Publication Data

US 2011/0312440 A1 Dec. 22, 2011

(30) Foreign Application Priority Data

Jun. 21, 2010 (JP) ..... 2010-141022

(51) Int. Cl.
*A63B 53/04* (2006.01)

(52) U.S. Cl.
USPC ..... 473/332; 473/345; 473/346

(58) Field of Classification Search
USPC ..... 473/324–350
See application file for complete search history.

(56) References Cited

U.S. PATENT DOCUMENTS

| | | | | | |
|---|---|---|---|---|---|
| 4,214,754 | A * | 7/1980 | Zebelean | 473/346 |
| 4,489,945 | A * | 12/1984 | Kobayashi | 473/346 |
| 5,213,328 | A * | 5/1993 | Long et al. | 473/346 |
| 5,485,998 | A * | 1/1996 | Kobayashi | 473/345 |
| 5,669,828 | A * | 9/1997 | Schmidt | 473/345 |
| 5,718,641 | A * | 2/1998 | Lin | 473/224 |
| 5,908,356 | A * | 6/1999 | Nagamoto | 473/224 |
| 5,941,782 | A * | 8/1999 | Cook | 473/346 |
| 6,494,790 | B1 * | 12/2002 | Toyota et al. | 473/345 |
| 6,524,194 | B2 * | 2/2003 | McCabe | 473/305 |
| 6,645,087 | B2 * | 11/2003 | Yabu | 473/342 |
| 6,679,786 | B2 * | 1/2004 | McCabe | 473/305 |
| 6,783,465 | B2 * | 8/2004 | Matsunaga | 473/329 |
| 6,852,038 | B2 * | 2/2005 | Yabu | 473/224 |
| 7,066,835 | B2 * | 6/2006 | Evans et al. | 473/346 |
| 7,241,230 | B2 * | 7/2007 | Tsunoda | 473/324 |
| 7,390,271 | B2 * | 6/2008 | Yamamoto | 473/345 |
| 7,431,668 | B2 * | 10/2008 | Tateno et al. | 473/346 |
| 7,435,191 | B2 * | 10/2008 | Tateno et al. | 473/346 |
| 7,758,453 | B2 * | 7/2010 | Horacek et al. | 473/345 |
| 8,226,500 | B2 * | 7/2012 | Yamamoto et al. | 473/346 |
| 8,246,489 | B2 * | 8/2012 | Yamamoto | 473/346 |

FOREIGN PATENT DOCUMENTS

| | | | | |
|---|---|---|---|---|
| JP | 07284546 | A * | 10/1995 | A63B 53/04 |
| JP | 09248353 | A * | 9/1997 | A63B 53/04 |
| JP | 10295859 | A * | 11/1998 | A63B 53/04 |
| JP | 11-155982 | A | 6/1999 | |
| JP | 2001353240 | A * | 12/2001 | A63B 53/04 |

(Continued)

OTHER PUBLICATIONS

Japanese Office Action, dated Jan. 17, 2014, issued in corresponding Japanese Patent Application No. 2010-141022.

*Primary Examiner* — Alvin Hunter
(74) *Attorney, Agent, or Firm* — Sughrue Mion, PLLC

(57) ABSTRACT

A hollow golf club head according to this invention includes a face portion, a crown portion, and a sole/side portion including a sole portion and a side portion. The sole/side portion includes a thin region formed to traverse at least the sole portion from the toe side to the heel side, and thick regions formed on the side of the face portion and the back side, respectively, with respect to the thin region to be adjacent to the thin region. The golf club head further includes a rib which extends from the toe side to the heel side only in the thin region of the thin region and the thick region, and is connected to the side portion on the toe side and the side portion on the heel side.

8 Claims, 6 Drawing Sheets

(56) References Cited

FOREIGN PATENT DOCUMENTS

| | | | | | |
|---|---|---|---|---|---|
| JP | 2002-186691 | A | | 7/2002 | |
| JP | 2003-102877 | A | | 4/2003 | |
| JP | 2003102877 | A | * | 4/2003 | ..... A63B 53/04 |
| JP | 2003-275345 | A | | 9/2003 | |
| JP | 2010005311 | A | * | 1/2010 | |
| JP | 2010-46338 | A | | 3/2010 | |
| JP | 2010115334 | A | * | 5/2010 | |

* cited by examiner

FIG. 6

| | REGION LAYOUT | RIB | NATURAL FREQUENCY (Hz) |
|---|---|---|---|
| #1 | I | ○ | 2940 |
| #2 | II | × | 2720 |
| #3 | II | ○ | 2860 |
| #4 | III | × | 2660 |
| #5 | III | ○ | 3170 |
| #6 | III | ○ | 3160 |
| #7 | I | × | 2460 |
| #8 | I | ○ | 2940 |
| #9 | III | ○ | 3120 |
| #10 | III | ○ | 3090 |
| #11 | III | ○ | 3240 |
| #12 | III | ○ | 3070 |

GOLF CLUB HEAD

BACKGROUND OF THE INVENTION

1. Field of the Invention

The present invention relates to a golf club head and, more particularly, to a technique for improving the sound of an impact.

2. Description of the Related Art

In hollow golf club heads typified by a driver head, techniques for improving the sound of an impact by appropriately designing the hollow body construction have been proposed. For example, Japanese Patent Laid-Open Nos. 11-155982 and 2003-275345 disclose techniques for improving the impact sound by partially varying the thickness of a sole portion. Also, Japanese Patent Laid-Open Nos. 2002-186691 and 2003-102877 disclose techniques for improving the impact sound by providing a rib in a sole portion.

The volume of the typical hollow golf club head is increasing every year as its crown portion and sole portion are getting thinner, and their areas are increasing along with this trend. Thus, a low-pitched impact sound is more likely to be generated at the time of striking a golf ball. However, there are golfers who prefer high-pitched impact sounds and hence want golf club heads which generate higher-pitched impact sounds. Partially varying the thickness of a sole portion as disclosed in Japanese Patent Laid-Open Nos. 11-155982 and 2003-275345 produces the effect of increasing the pitch of the impact sound, but this technique has its limits. Also, providing a rib in a sole portion as disclosed in Japanese Patent Laid-Open Nos. 2002-186691 and 2003-102877 produces the effect of increasing the pitch of the impact sound, but this too has its limits.

SUMMARY OF THE INVENTION

It is an object of the present invention to provide a golf club head which generates a higher-pitched impact sound despite its increased head volume.

According to the present invention, there is provided a hollow golf club head comprising a face portion, a crown portion, and a sole/side portion including a sole portion and a side portion, wherein the sole/side portion includes a thin region formed to traverse at least the sole portion from a toe side to a heel side, and thick regions formed on a side of the face portion and a back side, respectively, with respect to the thin region to be adjacent to the thin region, and the golf club head further comprises a rib which extends from the toe side to the heel side only in the thin region of the thin region and the thick region, and is connected to the side portion on the toe side and the side portion on the heel side.

Further features of the present invention will become apparent from the following description of exemplary embodiments with reference to the attached drawings.

BRIEF DESCRIPTION OF THE DRAWINGS

FIG. 6 is a table showing an analysis result.

DESCRIPTION OF THE EMBODIMENTS

Figure 1:
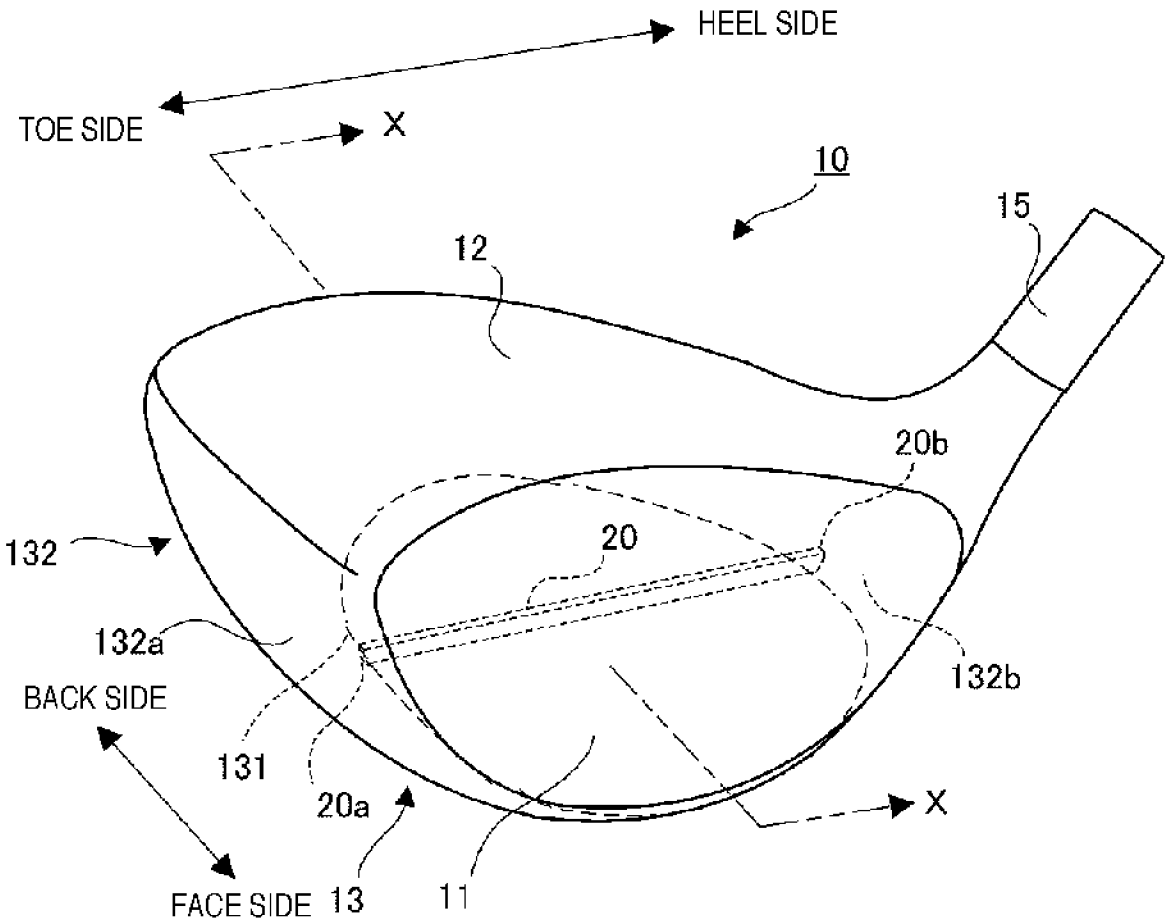
FIG. 1 is a perspective view of a golf club head 10 according to an embodiment of the present invention.
Figure 2A:
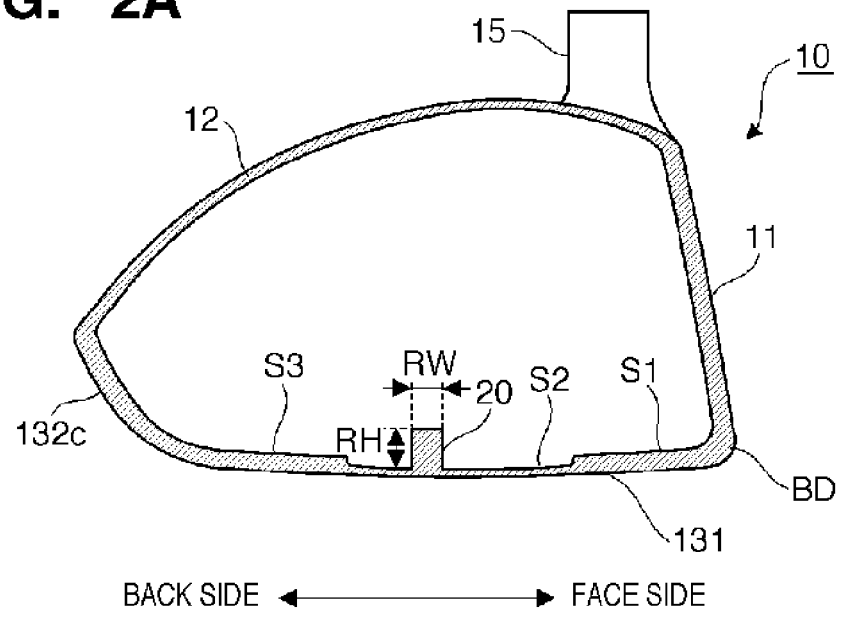
FIG. 2A is a sectional view taken along a line X-X in FIG. 1.
Figure 2B:
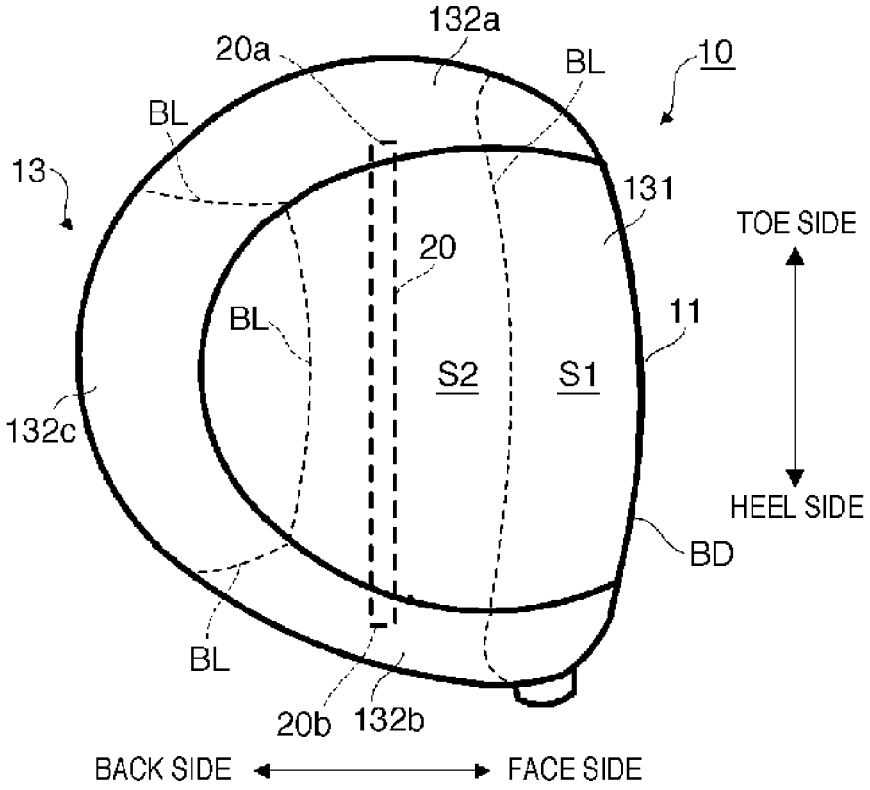
FIG. 2B is a view of the golf club head 10 when viewed from the side of a sole portion 131.

FIG. 1 is a perspective view of a golf club head 10 according to an embodiment of the present invention, where a rib 20 provided in it is seen through. FIG. 2A is a sectional view taken along a line X-X in FIG. 1, and FIG. 2B is a view of the golf club head 10 when viewed from the side of a sole portion 131.

The golf club head 10 takes the form of a hollow body, and its peripheral wall forms a face portion 11 which forms a face surface (striking surface), a crown portion 12 which forms the upper portion of the golf club head 10, and a sole/side portion 13. The sole/side portion 13 forms the sole portion 131 which forms the bottom portion of the golf club head 10, and a side portion 132 between the crown portion 12 and the sole portion 131. The side portion 132 forms the side portion of the golf club head 10, and includes a toe-side side portion 132*a*, heel-side side portion 132*b*, and back-side side portion 132*c*. The golf club head 10 also includes a hosel portion 15 to which a shaft is attached.

The golf club head 10 is a driver golf club head. However, the present invention is applicable not only to driver golf club heads but also to wood type golf club heads including, for example, a fairway wood type golf club head, utility (hybrid) golf club heads, and other hollow golf club heads. The golf club head 10 can be made of a metal material such as a titanium-based metal (for example, Ti-6Al-4V titanium alloy), stainless steel, or a copper alloy such as beryllium copper.

The golf club head 10 can be assembled by bonding a plurality of parts. The golf club head 10 can be formed from, for example, a main body member and a face member. The main body member forms the peripheral portions of the crown portion 12, sole portion 131, side portion 132, and face portion 11, and has an opening partially formed in a portion corresponding to the face portion 11. The face member is bonded into the opening in the main body member.

Referring to FIG. 2B, the golf club head 10 includes a plurality of regions S1 to S3 in which its peripheral wall has different thicknesses. A plurality of lines BL indicate the boundary lines between the regions S1 to S3. The thicknesses of the peripheral wall in the regions S1 to S3 satisfy relations: S1>S2 and S3>S2, so the region S2 is a thin region and the regions S1 and S3 are thick regions. The thickness of the thin region S2 is, for example, 0.8 mm, that of the thick region S1 is, for example, 1.4 mm, and that of the thick region S3 is, for example, 1.3 mm. Also, the thickness of the face portion 11 is, for example, 3 mm, and that of the crown portion 12 is, for example, 0.6 (inclusive) to 0.7 mm (inclusive).

The thin region S2 is formed so as to traverse at least the sole portion 131 from the toe side to the heel side. Although the thin region S2 extends even to the side portions 132*a* and 132*b* in this embodiment, it may be formed only in the sole portion 131.

The thick region S1 is formed on the side of the face portion 11 with respect to the thin region S2 to be adjacent to the thin region S2. In this embodiment, the thick region S1 starts from a boundary portion BD between the sole portion 131 and the face portion 11, and extends up to the edge of the thin region S2. Although the thick region S1 extends even to the side portions 132*a* and 132*b* in this embodiment, it may be formed only in the sole portion 131. In this case, the thick region S1 may be formed only in part of the sole portion 131.

The thick region S3 is formed on the back side (on the side of the back-side side portion 132*c*) with respect to the thin region S2 to be adjacent to the thin region S2. Although the thick region S3 extends even to the side portions 132*a* and 132*b* and back-side side portion 132*c* in this embodiment, it may be formed only in the sole portion 131, only in the sole portion 131 and back-side side portion 132*c*, or only in the sole portion 131 and side portions 132*a* and 132*b*.

Figure 3:
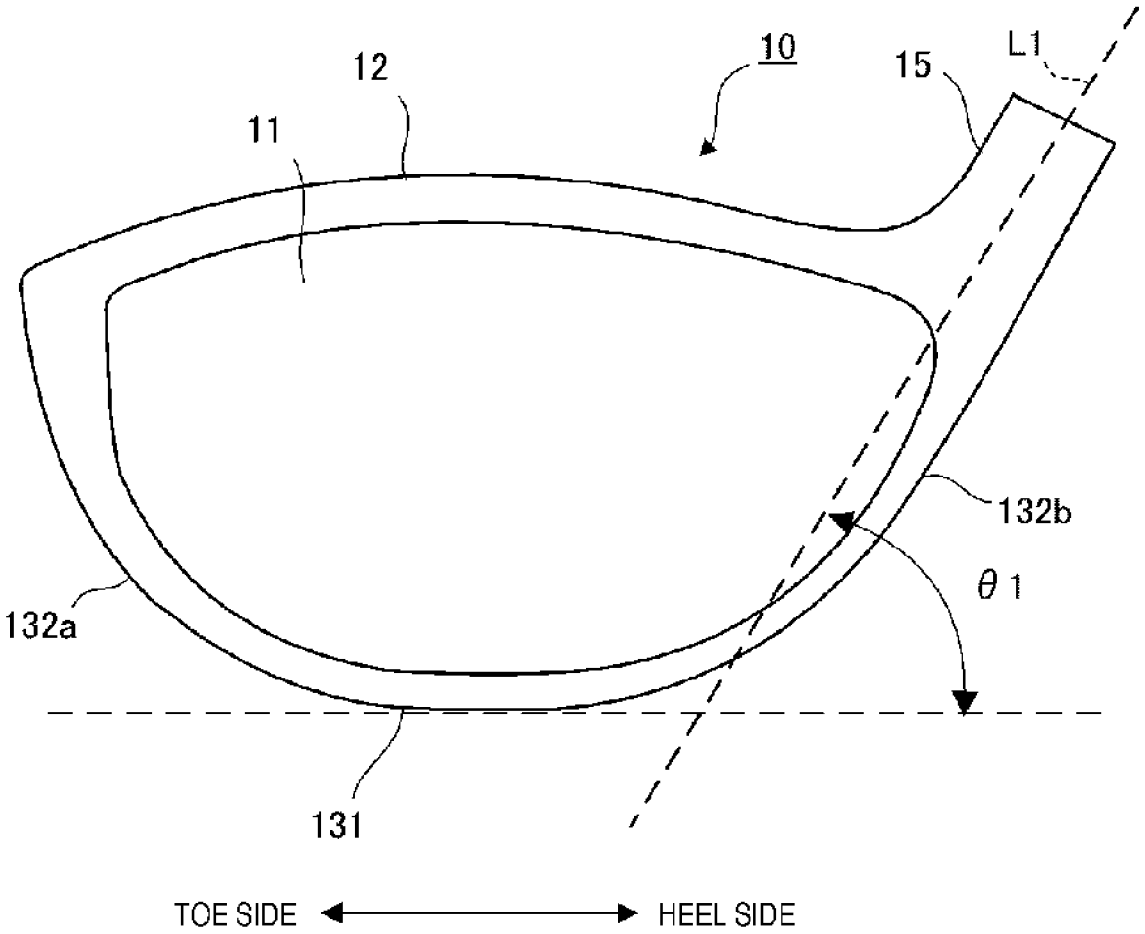
FIG. 3 is a front view of the golf club head 10 when viewed from the side of a face portion 11.
Figure 4A:
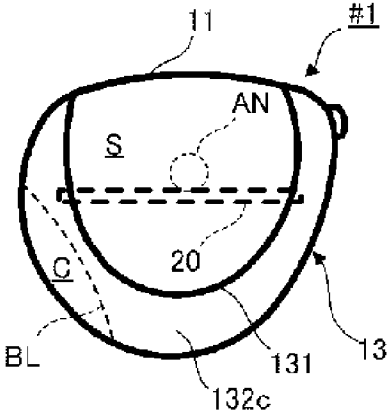
FIGS. 4A to 4F are views for explaining golf club heads #1 to #6.
Figure 4B:
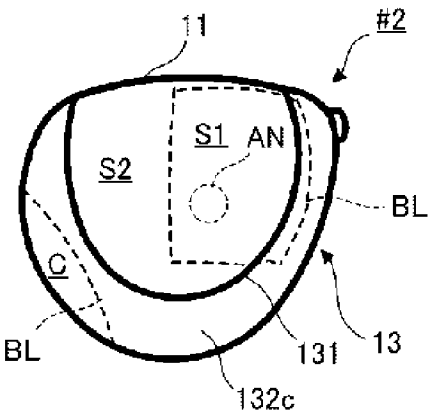
Figure 4C:
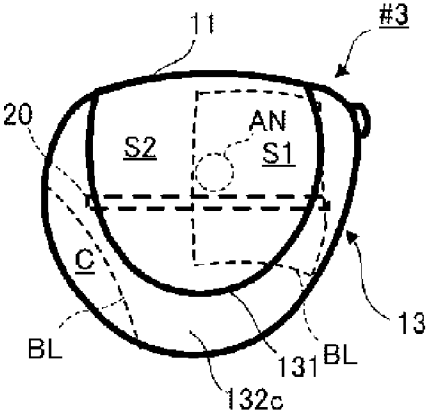
Figure 4D:
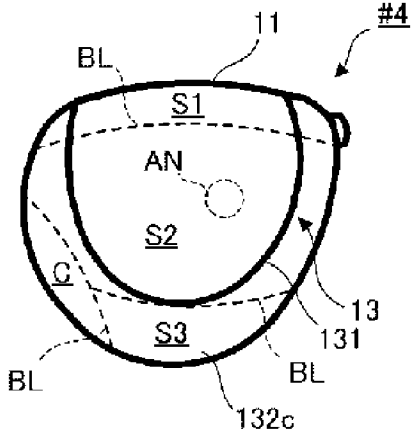
Figure 4E:
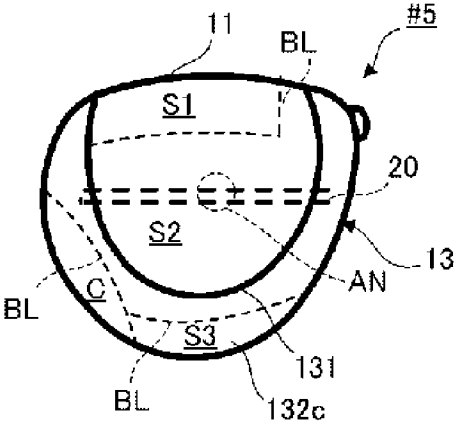
Figure 4F:
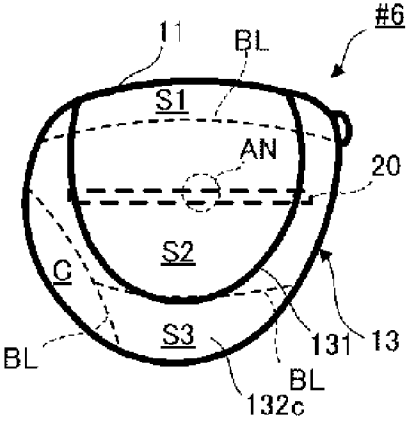
Figure 5A:
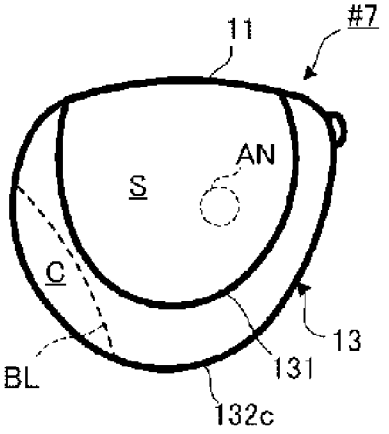
FIGS. 5A to 5F are views for explaining golf club heads #7 to #12.
Figure 5B:
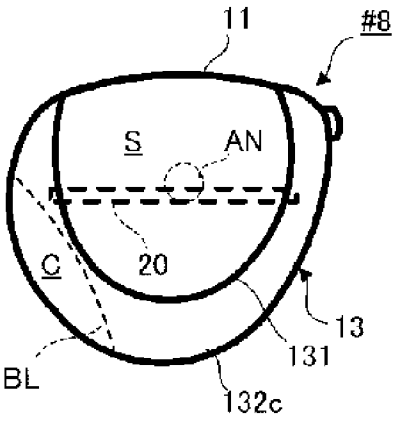
Figure 5C:
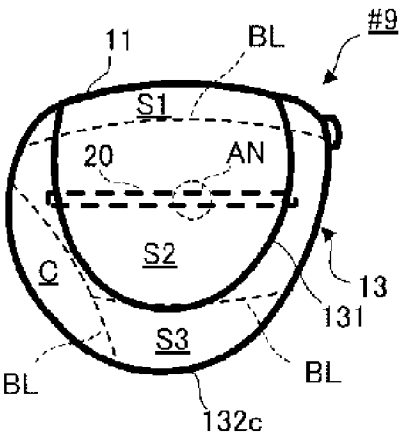
Figure 5D:
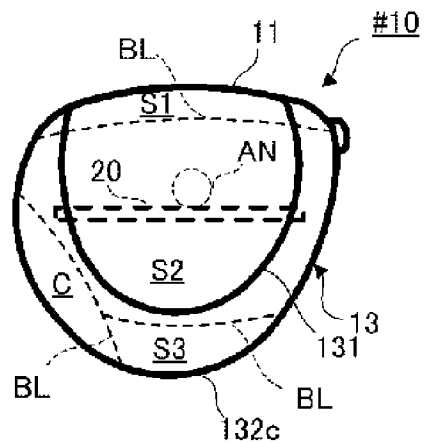
Figure 5E:
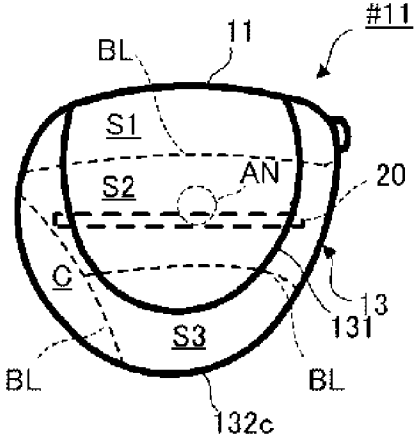
Figure 5F:
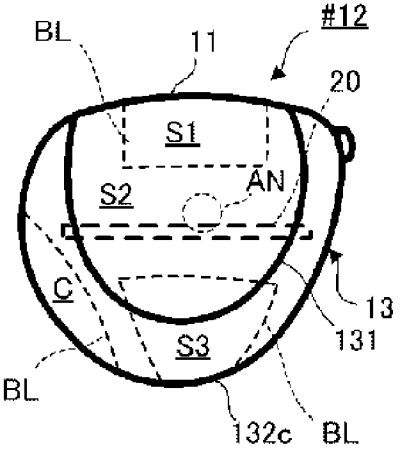

The dimensions of the thick regions S1 and S3 in the face-to-back direction are, for example, 10 mm (inclusive) to 50 mm (inclusive). Note that the face-to-back direction means the horizontal direction that coincides with the flight trajectory direction when the golf club head 10 is grounded such that the angle θ1 (lie angle) formed between a shaft axis line L1 and the ground surface becomes a specific lie angle defined for the golf club head 10, as shown in FIG. 3, and is normally a direction along a plane perpendicular to the central portion of the face portion 11. The toe-to-heel direction is a horizontal direction perpendicular to the face-to-back direction when the golf club head 10 is grounded in accordance with the specific lie angle.

Referring to FIGS. 1, 2A, and 2B, the elongated rib 20 which adjusts the natural frequency of the golf club head 10 is formed on the inner upper surface of the sole portion 131. The rib 20 extends from the toe side to the heel side only in the thin region S2, of the thick region S1, thin region S2 and thick region S3, to traverse the sole portion 131 from the toe side to the heel side. The rib 20 has its one end 20*a* connected to the toe-side side portion 132*a*, and its other end 20*b* connected to the heel-side side portion 132*b*. Although the rib 20 is shaped integrally with the sole portion 131 and side portions 132*a* and 132*b* in this embodiment, it may be provided as a separate member and firmly fixed on the sole portion 131 and side portions 132*a* and 132*b*.

Referring to FIG. 2A, the rib 20 has a height RH and width RW. The height RH is the height of the rib 20 from the upper surface of the sole portion 131 (thin region S2). In this embodiment, the height RH and width RW satisfy a relation: height RH>width RW. When the rib 20 has the same cross-sectional area, the effect of constraining the sole portion 131 is greater when height RH>width RW as in this embodiment than when height RH<width RW. The height RH is, for example, 3 mm (inclusive) to 10 mm (inclusive), and the width RW is, for example, 0.5 mm (inclusive) to 3 mm (inclusive).

The principle of improving the impact sound in this embodiment will be described next. In general, with an increase in head volume, the head peripheral wall needs to be thinner and the area of each portion increases, so the eigenvalue of the entire head decreases, and the eigenvalue (natural frequency) of the first-order vibration mode of the sole portion 131, in turn, decreases. Thus, a low-pitched impact sound is more likely to be generated at the time of striking a golf ball. In this embodiment, the sole portion 131 is constrained by providing the rib 20, so the eigenvalue of its first-order vibration mode increases. This makes it possible to increase the pitch of the impact sound.

In this embodiment, because the thick region S1, the thin region S2, and the thick region S3 are formed in the sole/side portion 13 in turn from the face side to the back side, the thin region S2 is more likely to vibrate at the time of striking a golf ball. By providing the rib 20 only in the thin region S2 of the regions S1 to S3, the thin region S2 is constrained by the rib 20, thus making it possible to further increase the pitch of the impact sound. Still better, because the thin region S2 is thin and is therefore more likely to vibrate, deterioration in echo of the impact sound can be avoided despite the provision of the rib 20, although an echo of the impact sound generally deteriorates upon the provision of the rib 20.

In this manner, the golf club head 10 according to this embodiment can generate the impact sound which echoes at a higher pitch despite its increased head volume. The head volume is, for example, 350 cc (inclusive) to 460 cc (inclusive).

Note that the thin region S2 preferably includes the position of an antinode of the first-order vibration mode of the sole portion 131. Thus, because the thick regions S1 and S3 are less likely to vibrate, and the thin region S2 is more likely to vibrate, it is possible to improve an echo of the impact sound and to increase the pitch of the impact sound by an effect of constraining the thin region S2 by the rib 20. The position of an antinode of the first-order vibration mode of the sole portion 131 can be obtained by modal analysis using a computer or eigenvalue analysis using the FEM.

EXAMPLE

Models of 12 golf club heads were designed on a computer, and vibration analysis was performed for each model on the computer. FIGS. 4A to 4F and 5A to 5F are views for explaining golf club heads #1 to #12 when viewed from the sides of sole portions. The same reference numerals denote arrangements corresponding to the above-described embodiment.

Golf club heads #1 to #12 are driver heads with the same shape and the same volume of 460 cc, and are different only in thickness distribution of a sole/side portion 13 and in presence/absence of a rib 20. The rib 20 has a height of 3.0 mm and a width of 1.5 mm, and is formed integrally with the sole/side portion 13. Golf club heads #1 to #12 are made of a titanium alloy (Ti-6Al-4V). However, referring to FIGS. 4A to 4F and 5A to 5F, portions indicated by regions C are made of a 1-mm thick carbon material.

Golf club head #1 has only a region S in which the sole/side portion 13 (excluding the region C (the same applies to other golf club heads)) has a single thickness of 0.80 mm. A rib 20 is formed in golf club head #1.

Golf club head #2 has a thick region S1 (thickness: 1.50 mm) and a thin region S2 (thickness: 0.90 mm), but has neither a region corresponding to a thick region S3 as in the above-described embodiment nor a rib.

Golf club head #3 has a thick region S1 (thickness: 1.30 mm) and a thin region S2 (thickness: 0.80 mm), but has no region corresponding to a thick region S3 as in the above-described embodiment. A rib 20 is formed in golf club head #3.

Golf club head #4 has a thick region S1 (thickness: 1.30 mm), a thin region S2 (thickness: 0.80 mm), and a thick region S3 (thickness: 1.30 mm), and has the thick regions S1 and S3 formed on the side of a face portion 11 and the back side, respectively, with respect to the thin region S2 to be adjacent to the thin region S2. However, golf club head #4 has no rib 20. Note that the dimension of the thin region S2 in the face-to-back direction is 70 mm.

Golf club head #5 has a thick region S1 (thickness: 1.30 mm), a thin region S2 (thickness: 0.80 mm), and a thick region S3 (thickness: 1.30 mm). Golf club head #5 has the thick regions S1 and S3 formed on the side of a face portion 11 and the back side, respectively, with respect to the thin region S2 to be adjacent to the thin region S2, and is provided with a rib 20, thus having an arrangement similar to that in the above-described embodiment. Note that the dimension of the thick region S1 in the face-to-back direction is 75 mm, and that of the thin region S2 is 70 mm.

Golf club head #6 has a thick region S1 (thickness: 1.25 mm), a thin region S2 (thickness: 0.8 mm), and a thick region S3 (thickness: 1.25 mm). Golf club head #6 has the thick regions S1 and S3 formed on the side of a face portion 11 and the back side, respectively, with respect to the thin region S2 to be adjacent to the thin region S2, and is provided with a rib 20, thus having an arrangement similar to that in the above-described embodiment. Note that the dimension of the thin region S2 in the face-to-back direction is 70 mm.

Golf club head #7 has only a region S in which the sole/side portion 13 has a single thickness of 1.3 mm. Golf club head #7 has no rib 20.

Golf club head #8 has only a region S in which the sole/side portion 13 has a single thickness of 1.3 mm. A rib 20 is formed in golf club head #8.

Golf club head #9 has a thick region S1 (thickness: 1.25 mm), a thin region S2 (thickness: 0.6 mm), and a thick region S3 (thickness: 1.25 mm). Golf club head #9 has the thick regions S1 and S3 formed on the side of a face portion 11 and the back side, respectively, with respect to the thin region S2 to be adjacent to the thin region S2, and is provided with a rib 20, thus having an arrangement similar to that in the above-described embodiment. Note that the dimension of the thin region S2 in the face-to-back direction is 70 mm.

Golf club head #10 has a thick region S1 (thickness: 1.25 mm), a thin region S2 (thickness: 0.6 mm), and a thick region S3 (thickness: 1.25 mm). Golf club head #10 has the thick regions S1 and S3 formed on the side of a face portion 11 and the back side, respectively, with respect to the thin region S2 to be adjacent to the thin region S2, and is provided with a rib 20, thus having an arrangement similar to that in the above-described embodiment. Note that the dimension of the thick region S1 in the face-to-back direction is 13 mm, and that of the thin region S2 is 80 mm.

Golf club head #11 has a thick region S1 (thickness: 1.25 mm), a thin region S2 (thickness: 0.6 mm), and a thick region S3 (thickness: 1.25 mm). Golf club head #11 has the thick regions S1 and S3 formed on the side of a face portion 11 and the back side, respectively, with respect to the thin region S2 to be adjacent to the thin region S2, and is provided with a rib 20, thus having an arrangement similar to that in the above-described embodiment. Note that the dimension of the thick region S1 in the face-to-back direction is 30 mm, that of the thin region S2 is 40 mm, and that of the thick region S3 is 50 mm.

Golf club head #12 has a thick region S1 (thickness: 1.25 mm), a thin region S2 (thickness: 0.6 mm), and a thick region S3 (thickness: 1.25 mm). Golf club head #12 has the thick regions S1 and S3 formed on the side of a face portion 11 and the back side, respectively, with respect to the thin region S2 to be adjacent to the thin region S2, and is provided with a rib 20, thus having an arrangement similar to that in the above-described embodiment. Note that the dimension of the thick region S1 in the face-to-back direction is 30 mm, that of the thin region S2 is 40 mm, and that of the thick region S3 is 50 mm. Note also that the dimension of the thick region S1 in the toe-to-heel direction is 45 mm.

FIG. 6 is a table showing an analysis result. Vibration analysis of the natural frequency (first-order vibration mode) was performed by computation using the FEM. Referring to FIGS. 4A to 4F and 5A to 5F, reference symbol AN denotes the position of an antinode of the first-order vibration mode, which was obtained as a result of this vibration analysis.

Referring to FIG. 6, the "Region Layout" indicates the type of thickness distribution of the sole/side portion 13. "I" corresponds to arrangements (golf club heads #1, #7, and #8) each with a single thickness. "II" corresponds to arrangements (golf club heads #2 and #3) each having two types of regions with different thicknesses. "III" corresponds to arrangements each having the thick regions S1 and S3 formed on the side of the face portion 11 and the back side, respectively, with respect to the thin region S2 to be adjacent to the thin region S2, as in the above-described embodiment.

Golf club heads #5, #6, and #9 to #12 each having region layout III and the rib 20 have natural frequencies more than 3,000 Hz, thus achieving results that are satisfactory in terms of obtaining high-pitched impact sounds. As can be seen especially from comparisons between golf club heads #1 and #8 and golf club heads #5, #6, and #9 to #12, the pitch of the impact sound cannot be considerably increased merely by providing the rib 20 in a golf club head. Also, as can be seen from comparisons between golf club head #3 and golf club heads #5, #6, and #9 to #12, the pitch of the impact sound cannot be considerably increased as well merely by providing the rib 20 in a golf club head and forming regions with different thicknesses in the sole/side portion 13, as in golf club head #3. Moreover, as can be seen from comparisons between golf club head #4 and golf club heads #5, #6, and #9 to #12, the pitch of the impact sound cannot be considerably increased when no rib 20 is provided in a golf club head despite the adoption of region layout III.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-141022, filed Jun. 21, 2010, which is hereby incorporated by reference herein in its entirety.

What is claimed is:

1. A hollow golf club head comprising a face portion, a crown portion, and a sole/side portion including a sole portion and a side portion, wherein the sole/side portion includes a thin region formed to traverse at least the sole portion from a toe side to a heel side, and thick regions formed on a side of the face portion and a back side, respectively, with respect to the thin region to be adjacent to the thin region, the golf club head further comprises a rib which extends from the toe side to the heel side only in the thin region of the thin region and the thick regions, the rib is not connected to the thick regions, and the rib is connected to the side portion on the toe side and the side portion on the heel side.

2. The head according to claim 1, wherein the thin region includes a position of an antinode of a first-order vibration mode of the sole portion at a time of impact.

3. The head according to claim 1, wherein a height of said rib is more than a width of said rib.

4. The head according to claim 1, wherein a dimension of each of the thick region in a face-to-back direction is 10 mm (inclusive) to 50 mm (inclusive).

5. The head according to claim 1, wherein a head volume is not less than 350 cc.

6. The head according to claim 1, wherein a dimension of the thin region in a face-to-back direction is 40 mm (inclusive) to 80 mm (inclusive).

7. The head according to claim 1, wherein the side portion includes a back-side side portion, and the thick region on the side of the back side is formed from the sole portion to a boundary portion between the crown portion and the back-side side portion.

8. The head according to claim 1, wherein the thick region on the side of the face portion is formed from a boundary portion between the sole portion and the face portion up to an edge of the thin region, and the thick region on the side of the face portion only in the sole portion.

* * * * *